US006834397B1

(12) United States Patent
Murphy

(10) Patent No.: US 6,834,397 B1
(45) Date of Patent: Dec. 28, 2004

(54) WINDSURFING PALM HARNESS

(76) Inventor: Mark Murphy, 2631 Lansdowne, Waterford, MI (US) 48329

( * ) Notice: Subject to any disclaimer, the term of this patent is extended or adjusted under 35 U.S.C. 154(b) by 3 days.

(21) Appl. No.: 10/413,929

(22) Filed: Apr. 15, 2003

Related U.S. Application Data

(63) Continuation-in-part of application No. 10/077,235, filed on Feb. 15, 2002, now abandoned.

(51) Int. Cl.[7] ..... A41D 19/00
(52) U.S. Cl. ..... 2/161.1
(58) Field of Search ..... 2/159, 160, 161.1, 2/161.2, 161.4, 161.5, 161.6, 163, 16, 17, 20, 162, 170; 482/106; 114/39, 18

(56) References Cited

U.S. PATENT DOCUMENTS 3,417,840 A * 12/1968 Farnsworth, Jr. ..... 182/8
4,400,831 A * 8/1983 Rietz ..... 2/161.1
4,487,412 A * 12/1984 Meeko ..... 482/139
4,720,279 A * 1/1988 Fritschen et al. ..... 441/69
4,745,870 A * 5/1988 Roth ..... 114/39.18
5,050,516 A * 9/1991 Soudan, Jr. ..... 114/39.18
5,298,001 A * 3/1994 Goodson ..... 482/23
5,353,440 A * 10/1994 Meldeau ..... 2/161.1
5,770,297 A * 6/1998 Grubich ..... 428/99
5,809,570 A * 9/1998 Grover ..... 2/161.1
5,898,944 A * 5/1999 Vrany ..... 2/161.4

* cited by examiner

*Primary Examiner*—Gary L. Welch
(74) *Attorney, Agent, or Firm*—John R. Benefiel

(57) ABSTRACT

A harness for use in windsurfing which includes an adjustable wrist strap for securing the harness to the wrist of the wearer, an elongated support connected at one end to the wrist strap and which includes a rigid end portion which defines a curved hook for capturing a generally rounded in section boom. The elongated support further includes an intermediate adjustable finger loop which enables an immediate unhooking of the end portion by a backward bending of the hand at the wrist pulling the hook out of engagement with the boom. The harness transfers some or all of the force required to hold the boom to the wearer's forearm to reduce the effort required.

10 Claims, 6 Drawing Sheets

WINDSURFING PALM HARNESS

CROSS REFERENCE TO RELATED APPLICATIONS

This application is a continuation-in-part of U.S. application Ser. No. 10/077,235, filed Feb. 15, 2002 now abandoned.

BACKGROUND OF THE INVENTION

1. Field of the Invention

The subject invention relates to a harness for use with a windsurfer and, more particularly, to a palm harness which aids in holding the boom of a windsurfer.

2. Description of the Prior Art

In many sports activities, it is desirable for the participant to utilize specially designed gloves for aiding in gripping, reducing stresses, and protecting the participant's hands from undesirous effects from the sport, such as, blisters or calluses. This is especially true for sports which require gripping or holding an implement of the sport for extended periods of time. An example of this is U.S. Pat. No. 5,898,944 by Vranny. The '944 patent discloses a glove for use in a sport which requires swinging a sports implement which includes a palm strap extending across the palm portion of the glove which is attached to the glove by a first end at the wrist area and extends to a second end which includes two openings for inserting the wearer's fingers. A protrusion is attached transversely to the palm strap for wrapping around the implement of the sport. The combination of the palm strap and the protrusion is to transfer forces from swinging of the implement to the wrist of the wearer, and therefore, to allow the wearer to use less force in gripping the implement, thereby, helping to create a whipping action with the implement.

Another example of this type of invention, specifically for use in water sports, is U.S. Pat. No. 5,809,570 by Grover. The '570 patent discloses a glove for securing a grip around a roundish-like object, such as a waterskiing tow bar. The gripping device is an elongated, flat, sliding, strap loop with a gripping second having an anchor at one end in the form of a wrist cinching strap. The front of the friction or gripping pad continues in a loop which lays back over the gripping pad and extends to the underside of the wrist and attaches to a plastic sleeve which snugly fits around the user's wrist to keep the top strap properly located above the grip strap. The strap is to transfer the forces required to secure the object to the wrist strap, thereby, transferring a portion of forces required to gripping the object.

Additionally, there are harness type attachment means which are used in conjunction with a shoulder brace. An example of this type of invention is U.S. Pat. No. 4,745,870 by Roth. The '870 patent discloses a harness which includes a jacket and a pair of sleeves, either long or short. If short sleeves are used, the harness includes a plurality of forearm and wrist straps. If long sleeves are used, they are generally made of the same material as that used for the jacket is used. The jacket includes a cross shoulder brace for cradling the shoulders and upper back while windsurfing. The jacket further includes a pair of rear arm support braces for providing support to the rear arms of the windsurfer. The shoulder brace and the arm support braces may be sewn into the jacket. The arm support braces are attached to at least one boom hook strap that is interconnected to a boom hook. The boom hook is for removably attaching to a boom that controls the sail of the windsurfer. Therefore, the boom hook transfers the load of the sail through the boom hooks to the boom hook strap through the arm support braces and across the shoulder brace. This transfer of the load allows for the distribution of the load amongst the aforementioned sections.

However, the aforementioned gloves and harnesses each have inherent flaws with respect to use in a windsurfing application. The '944 patent is intended to be used in a sport which includes a swinging implement, such as golf, in which the protrusion acts as a guide and grip aid. In a windsurfing application, the glove would not engage the boom as required to relieve the stresses on the hand. The '570 patent shows an invention which essentially aids in gripping an object, but still requires much force to be exerted by the wearer to keep the gripping device in contact with the object, thereby still causing strain in the wearers forearms. The '870 patent shows an invention which requires the wearer to don a jacket and hook onto the boom of the windsurfer. This allows for the distribution of forces across the body, but may cause undue stress upon the shoulders of the wearer as the harness would pull the shoulders together causing an uncomfortable situation and extra strain along the back. The jacket is also more cumbersome for the wearer and impedes the motion the wearer desires to make. Furthermore, the boom hook is not connected to the wearer's hands, and therefore, may not be easily removed from the boom when a situation arises requiring fast disengagement from the boom.

Therefore, there is a need for a harness or glove which may be removably attached at the wrist of the wearer and which assists in reducing the effort required to hold onto the boom by transferring the forces required to the wearer's forearm and enables quick and easy disengagement from the boom.

SUMMARY OF THE INVENTION

According to one aspect of the invention, a palm harness is provided for use in windsurfing. The palm harness comprises a wrist strap and an elongated support having a first end secured to said wrist strap so as to be able to be flexed, and a second distal end. The elongated support extends up across the palm and along the fingers of the wearer. A substantially rigid end portion is located at the second end of the elongated support, the end portion being hook shaped and curved so as to allow capture of the boom when placed over the boom, but to not grip the same so as to avoid any resistance to be unhooked from the boom.

A finger attachment loop is attached to the elongated support which enables one or more fingers to be secured to the elongated support, the finger attachment enabling rearward flexing of the elongate support by a hand movement created by rearward bending at the wrist, and creating a pulling motion instantly disengaging the hook shaped end portion from the boom.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
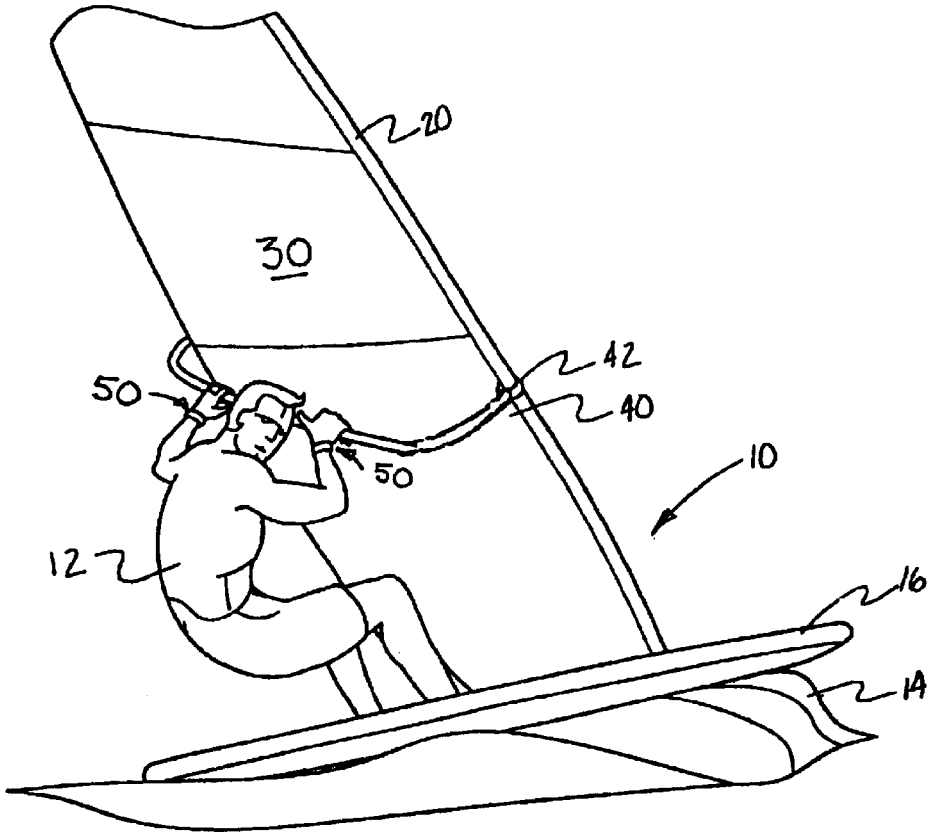
FIG. 1 is a perspective illustration of a wind surfer with an individual using the palm harness of the present invention.

Referring to FIG. 1, a palm harness is generally shown at 50 for use on a windsurfer 10. The windsurfer 10 is for providing wind-powered motion to an individual 12 while being on top of a body of water 14. The windsurfer 10 generally comprises a sailboard 16, a mast 20, a sail 30, and a boom 40. The sailboard 16 is comprised of a generally rectangular and generally planar member for supporting an individual 12 above water. The sailboard 16 is buoyant, that is, the sailboard 16 and the individual 12 together is lighter than the water displaced, and therefore, is able to support the individual 12 and the windsurfer 10 above the water 14. The sailboard 16 includes a swivel attachment (not shown) for pivotably coupling the sailboard 16 and the mast 20. The mast 20 provides vertical height and support to the sail 30. The sail 30 comprises a material for converting potential energy of the wind to generally forward, kinetic energy and is supported along the mast 20 for transferring the energy to the sailboard 16, and thus the individual 12 atop the sailboard 16. The boom 40 is removably attached to the mast 20 by a collar 42. The boom 40, when attached, is generally rigid and provides the individual 12 with the ability to maneuver the mast 20, and therefore the sail 30, for controlling the velocity and direction of the windsurfer 10, The individual 12 is therefore supported by grasping the boom 40 and balancing on the sailboard 16.

Figure 2:
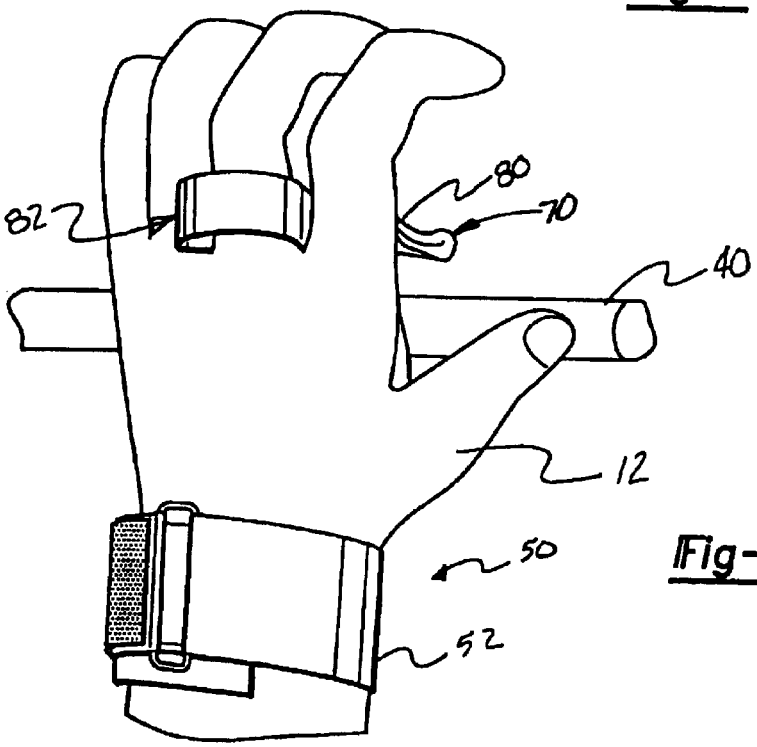
FIG. 2 is an isometric view of an individual wearing a windsurfing palm harness and showing the interaction between the harness and windsurfer boom.
Figure 5:
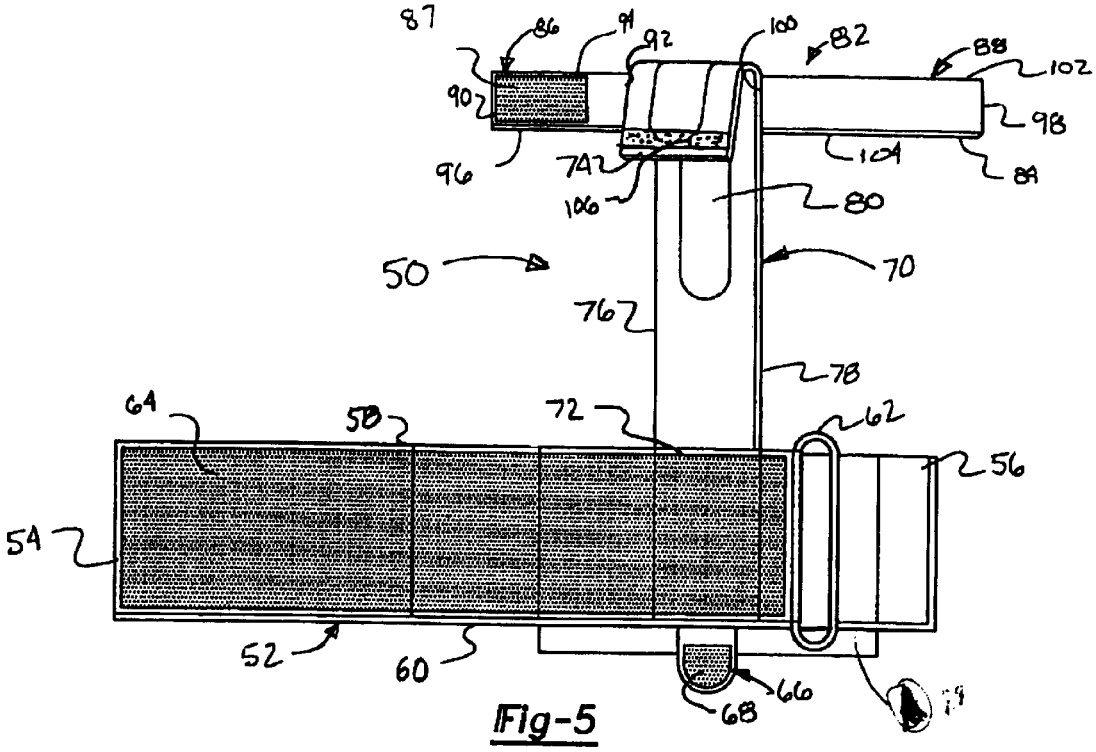
FIG. 5 is an isometric view of the palm harness in the expanded position.
Figure 6:
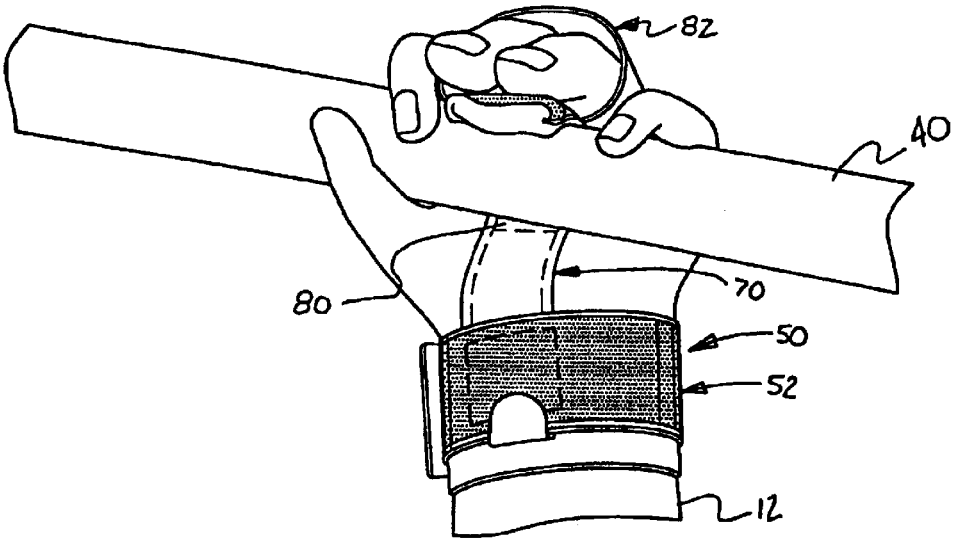
FIG. 6 is an isometric view of the palm harness capturing the boom of the windsurfer.
Figure 7:
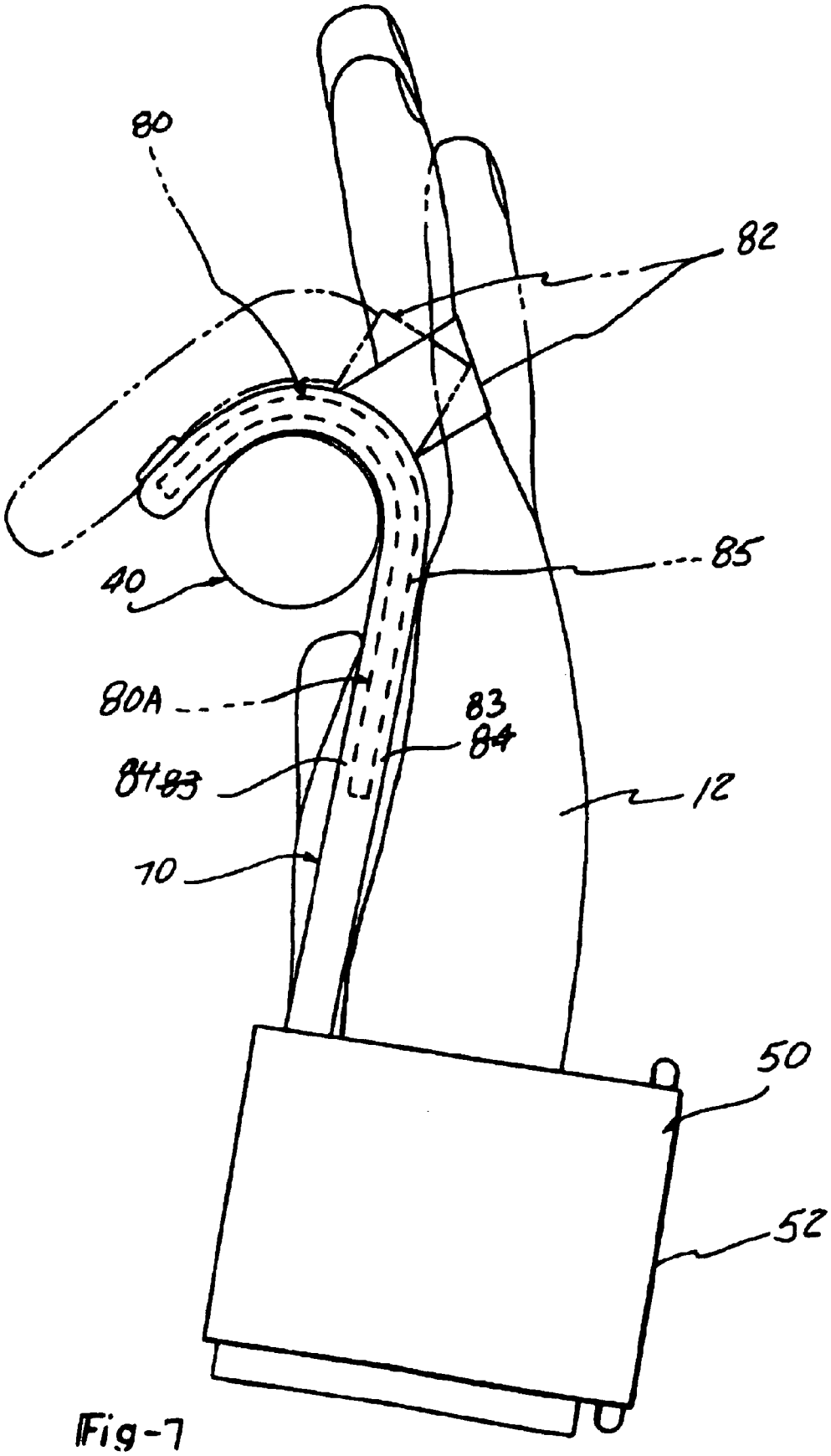
FIG. 7 is a side view of the palm harness and multiple positions of the fingers engaged therewith.

As shown in FIGS. 2, 6, and 7, the individual 12 maybe aided in holding the boom 40 when wearing the palm harness 50 according to the invention. The palm harness 50 is preferably made from a woven nylon or similar flexible material that resists adverse effects of water, such as, shrinkage, mildew, and the like. The palm harness 50 includes a wrist strap 52 for securing the palm harness 50 to the forearm or wrist area of an individual 12. Referring to FIG. 5, the wrist strap 52 comprises a first end 54 and a distal second end 56 interconnected and spaced apart by first and second sides 58,60. The wrist strap 52 includes a turning loop 62 secured inward of the second end 56 such that the second end 56 extends beyond the turning loop 62 so that the turning loop 62 does not contact the individual 12, and thereby provides further comfort to the individual 12.

The turning loop 62 may be made from a rigid plastic, metal, or other suitable material. The turning loop 62 is generally oval, but may be of any such shape for permitting the first end 54 of the wrist strap 52 to be thread through and to be doubled back upon itself for allowing the wrist strap 52 to be adjusted to fit a myriad of arm sizes. The wrist strap 52 further includes a closure device 64, such as hook and loop material for securing the wrist strap 52 to a lower arm once positioned through the turn loop 62 and adjusted for fit. The wrist strap 52 may further be covered with Neoprene padding for further comfort to the individual without varying from the scope of the invention.

The wrist strap 52 also includes a securing tab 66. The securing tab 66 includes a portion of a closure device 68, such as, the hook portion of the hook and loop material, one end of snap, or part of another suitable closure device, extending downwardly from the second side 60. The securing tab 66 will be discussed in further detail below.

Figure 8:
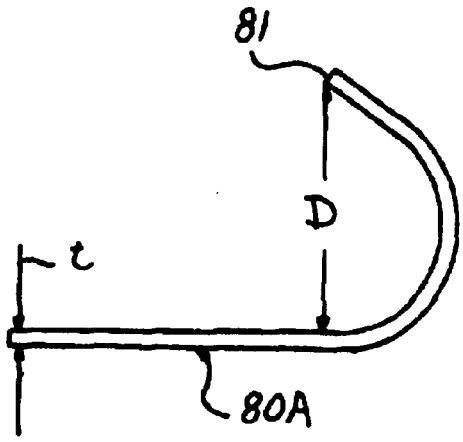
FIG. 8 is a side view of a rigid insert forming the shape of the end portion of the elongated support.
Figure 9:
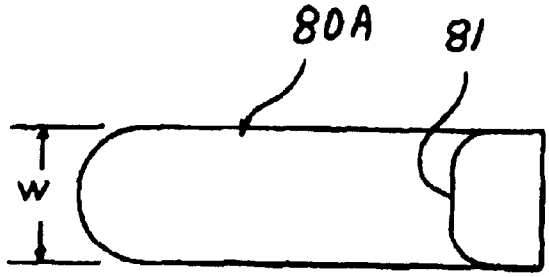
FIG. 9 is a top view of the insert shown in FIG. 8.
Figure 12:
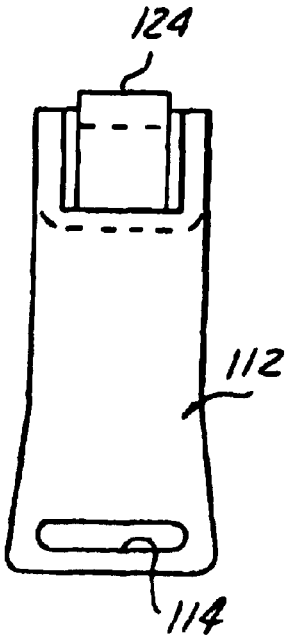
FIG. 12 is a front view of the curved end portion included in the elongate support of FIG. 10.
Figure 11:
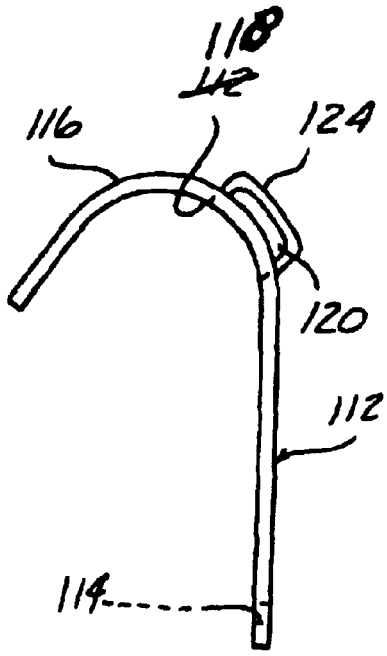
FIG. 11 is a side view of the curved end portion included in the elongate support of FIG. 10.
Figure 10:
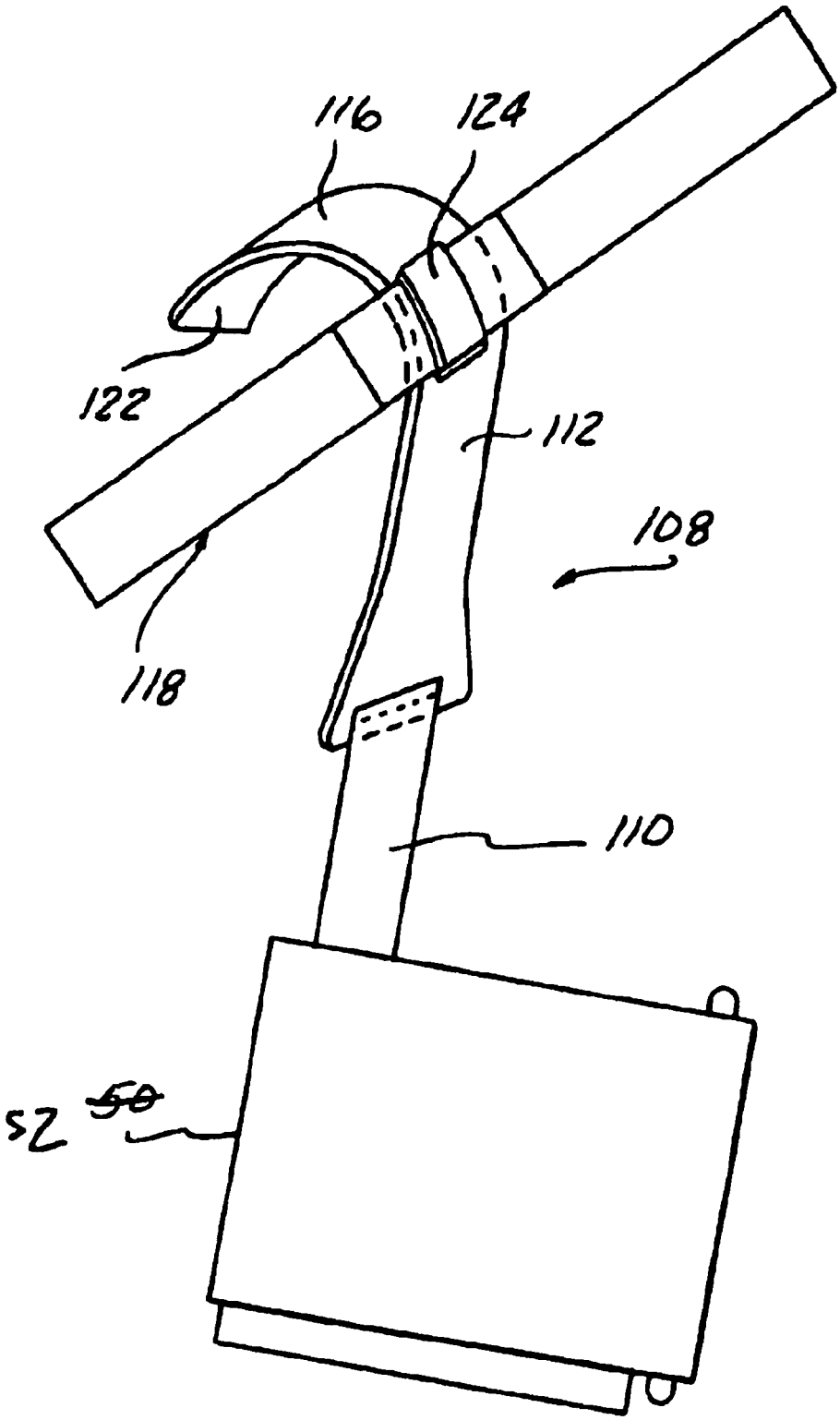
FIG. 10 is an isometric view of a palm harness having an alternate form of the elongate support and a finger securer loop strap shown in the extended condition.

The wrist strap 52 has an elongated support 70 extending upwardly from the first side 58, generally opposite of the securing tab 66 to extend across the palm and partway along the inside of the wearer's fingers. The elongated support 70 includes a first end 72 and a second distal end 74 interconnected and spaced apart by first and second sides 76, 78. The first end 72 is secured to the wrist strap 52 so as to allow rearward flexing of the elongated support 70 as will be described below. The second end 74 of the support 70 includes a preformed generally rigid end portion 80 having one end curved to form a hook. The end portion 80 extends from the second end 74 to a mid point of a wearer's palm and, therefore, at least partially between the first end 72 and the second end 74, and may be defined by a generally J-shaped insert 80A (FIGS. 7, 8 and 9). The rigid end portion 80 may be formed from metal, plastic, or other similar material that will provide the required rigidity and which may be fixedly secured to the elongated support 70 by adhesive, fasteners, molding, or comparable attachment methods.

It is critical that the boom 40 be able to be released substantially instantly when desired. In order to insure that this can easily be done by the flexing motion of the hand, the hooked end portion 80 is curved to match the generally rounded cross-sectional shape of the boom 40 so as to partially encircle the same without creating a gripping engagement by having a radius at least as great as that of the boom 40, as shown in FIG. 7. The inner curvature of the insert 80A should take into account the thickness of any covering material as shown in being matched to the boom diameter. The diameter D of the end portion insert 80A taking into account the covering material should be at least at large as the diameter of the boom section so as to not create any gripping engagement that would resist unhooking and thus allow release of the boom 40. The rounded end 81 should be slightly flared out as indicated in FIGS. 7 and 8 to aid in release of the boom 40. The end portion insert 80A could be constructed of a thickness of 2.0 mm of 1060 steel, (suitably coated to be protected against rust). Also, the hooked end portion 80 should lie as close to the surface of the boom 40 as possible so that the fingers overlying the end portion 80 are as close to being even with the other fingers as possible to improve the hold of the user.

The end portion 80 is shaped to provide a curved, comfortable resting place for at least one finger and further includes a curved hook for capturing the boom 40, as shown in FIGS. 6 and 7, while allowing for very rapid and easy unhooking from the boom 40, as shown in FIG. 2, whenever the individual 12 desires.

Figure 4:
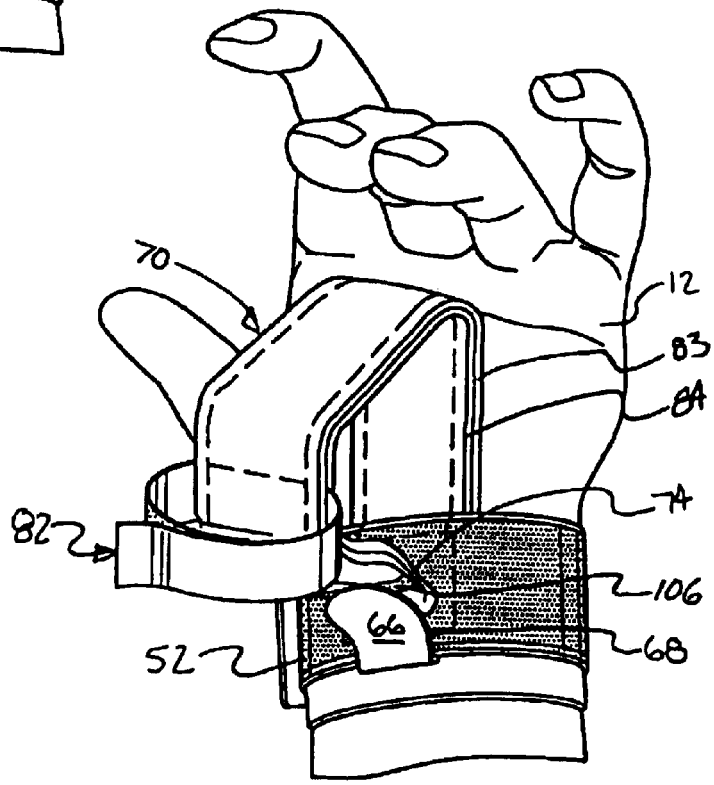
FIG. 4 is an isometric view of the palm harness with the fingers disengaged from the harness with a portion of the harness being secured by a securing tab.

Referring to FIG. 4, the elongated support 70 may be made of one or more layers of flexible material having at least an inner layer 83 and an outer layer 84 which may be secured together to form a pocket 85 therebetween. If multiple layers are used, the insert forming the rigid end portion 80 may be inserted between the inner layer 83 and the outer layer 84 and secured therebetween by creating a sewn pocket or any of the aforementioned securing methods.

Referring again to FIG. 5, the support end portion 80 transfers the forces associated with holding the boom 40 to an individual's forearm, by tensioning the elongated support 70 and thereby transferring the forces to the wrist strap 52. The support end portion 80 may also be covered with padding or reinforcement material, within the scope of the invention, to further comfort the wearer and increase the durability of the palm harness 50. The elongated support 70 may include a sizing device, such as, a turning loop and a securing device similar to that of the wrist strap 52, within the scope of the invention.

In order to enable substantially instantaneous release of the boom 40 when desired, the elongated support 70 further includes a finger securer loop 82 so that rearward hand movement produced by bending back at the wrist will produce flexing movement of the elongated support 70 and an instant pulling motion causing disengagement of the end portion 80 from the boom 40. The finger securer loop 82 is preferably located at the apex of the hooked end portion 80, as seen in FIG. 7.

The finger securer loop 82 is comprised of a first strap 86 and a second strap 88. The finger securer loop 82 may also be comprised of a single strap without departing from the spirit of the invention. The first strap 86 includes first and second ends 90, 92 interconnected and spaced apart by first and second sides 94, 96. The first strap 86 is secured to the first side 76 of the grip support 70 at generally the second end 92. Likewise, the second strap 88 includes first and second ends 98, 100 interconnected and spaced apart by first and second sides 102, 104. The second strap 88 is secured to the second side 78 of the grip support 70 generally opposite the first strap 86.

The finger securer loop 82 includes a closure device 87, such as hook and loop material or another suitable closure device located on both the first and second straps 86, 88. The finger securer loop 82 removably secures one or more of an individual's fingers to the end portion 80 and is positioned along or adjacent the apex of the hook curve of the end portion 80 for providing the individual 12 with the ability to extend the secured finger(s) while maintaining tension on the boom 40 through the wrist strap 52 and resting the individual's hand. Additionally, the curve of the end portion 80 is of such design that the individual 12 may easily move, shift, or remove the elongated support 70 from the boom 40 by simply bending the hand at the wrist, pulling the end portion out of engagement from the boom 40 as described above.

As shown in FIG. 4, the second end 74 of the elongated support 70 also includes an opposing closure device 106, such as a patch of loop portion of hook and loop material, attachable to the closure device 68 located on the securing tab 66. The closure device 106 and the closure device 68 interact with each other for providing a means of securing the elongated support 70 to the wrist strap 52 when the individual no longer desires to use the elongated support 70, and thereby, the elongated support 70 will not interfere with other actions of the individual 12.

Figure 3:
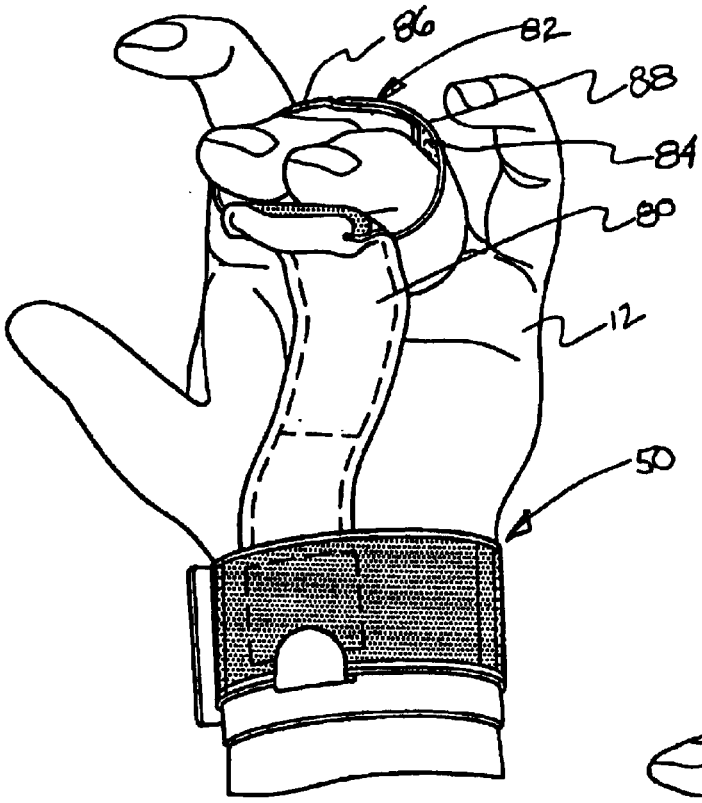
FIG. 3 is an isometric view of the palm harness with the fingers engaged in the harness.

In operation, as illustrated in FIG. 3, the palm harness 50 is placed in the palm of the individual's hand such that the curve of the end portion 80 is resting along the inside of the individual's fingers that the individual 12 desires to be supported. Referring now to FIG. 5, the individual threads the first end 54 of the wrist strap 52 through the turning loop 62. The first end 54 of the wrist strap 52 is then folded back upon itself and pulled until the desired tension is achieve on the individual's wrist. The wrist strap 52 may then be secured by utilizing the closure device 64 to maintain the tension selected.

Referring to FIG. 3, the individual may then position the first strap 86 of the finger securer 82 on the desired finger(s) to be secured. The second strap 88 is positioned over the first strap 86 and is then secured by way of the closure device 87. The wearer may repeat the aforementioned steps on the opposite hand if more than one palm harness 50 is desired to be used.

Referring to FIG. 2, the individual may mount the windsurfer 10 placing the elongated support 70, and, more particularly, the curved hook end portion 80 over the boom 40 to hold the same. As best illustrated in FIGS. 6 and 7, the hooked curve shape of the end portion 80 in which the distal end partially projects back towards the connected end of the support 70 captures and holds the boom 40 while the fingers are relaxed but without gripping the same, so as to put the elongated support 70 into tension, and thereby transferring the forces to the wrist strap 52 and reducing the stresses on the individual's hand and fingers. As seen in FIG. 7, the inside diameter of the hooked end of support structure 80, with the padding thickness, is matched to the rounded boom cross sectional diameter to enable substantially instant release when desired.

Referring to FIG. 2, the boom 40 may be immediately released when it is desired or necessary to dismount the windsurfer 10. This is enabled by the curvature associated with the hooked end portion 80 and the finger securer loop 82. The individual, having one or more fingers secured to the elongated support 70 by the finger securer loop 82, may bend the hand backwards at the wrist, thereby creating an upward and backward pulling motion of the hooked contour end portion 80. The upward pulling motion causes the end portion 80 to be immediately unhooked to release the boom 40.

As noted above, the hook contour should not create any gripping of the boom 40 since this would resist and possibly retard release therefrom. As seen in FIG. 7, the tip of the hook shape may be straightened to insure this result.

While the hooked contour end portion 80 still holds the boom 40, as in FIGS. 6 and 7, the individual 12 may relax the finger(s) held in place by the finger securer 82. The individual 12, therefore, may remain sailing the windsurfer 10 while resting the hand. As shown in FIG. 7, the finger(s) may be extended while within the finger securer 82 for use in controlling the sail 20, swimming, or other maneuvers that require the use of the finger(s).

Additionally, referring to FIG. 4, when the individual no longer desires to utilize the elongated support 70, the individual 12 may remove the one or more fingers held in place by the finger securer loop 82. The elongated support 70 may then be folded down and secured to the securing tab 66 by interconnecting the closure device 68 of the securing tab 66 to the closure device 106 of the second end 74 of the elongated support 70. Once secured in this fashion, the individual's hands may be utilized for grasping items unimpeded by the palm harness 50.

It should be noted that the palm harness 50, as described above, could be adapted to function as a glove without varying from the scope of the invention.

The invention has been described in an illustrative manner, and it is to be understood that the terminology, which has been used, is intended to be in the nature of words of description rather than of limitation.

Many modification and variations of the present invention are possible in light of the above teachings. It is, therefore, to be understood that within the scope of the appended claims, the invention may be practiced other than as specifically described.

For example, as shown in FIGS. 1–12, a second two piece form of the elongated support may include a short flexible strap 110 sewn or otherwise attached at one end to the wrist strap 52. The other end of the short strap 110 is secured to a substantially rigid high strength plastic or metal piece 112 here forming the curved hook end portion 116 of the elongated support 108. This securement may be provided by the strap 110 being looped through a slot 114 adjacent a shank end of the piece 112.

The curved hook end portion 116 of the piece 112 is shaped to project the distal end partially back towards the shank end in order to create the hook shape and to capture and hold the boom 40 with the wearer's fingers relaxed but without any gripping action between the end portion 116 and the boom to ensure a completely unrestricted unhooking as described above.

A finger securing loop forming strap 118 (shown extended) is provided secured to the curved hook end portion 116 adjacent the apex of the hook shape.

The strap 118 can be secured by being passed through slots 120 formed by a raised section 124 of the piece hook portion 116. This positions the strap 118 substantially above the inside surface 122 of the hook shape 116.

What is claimed is:

1. A palm harness for use in windsurfing to allow a wearer to hold a generally rounded in section boom with one hand while relaxing the fingers of the one hand, comprising:

a wrist strap able to be worn encircling the wearer's wrist below the wearer's hand;

an elongated support having a first end and a second distal end, said first end connected to said wrist strap so as to allow flexing of said elongated support with respect to said wrist strap, said elongated support extending along the fingers of the wearer's one hand;

said second end partially projecting back towards first end to enable hooking of said elongated support to said boom;

said elongated support including a generally rigid and curved end portion at said second end of said elongated support, said end portion having a curved hook contour for releasably capturing said generally rounded in section boom so as to place said elongated support in tension and releasably hold said boom to said wrist strap and thereby to the wearer's forearm when the fingers of the wearer's hand are relaxed; and a finger securer loop positioned between said first and second ends of said elongated support securing said elongated support to at least one finger of a user so as to enable a pulling motion on said end portion producing unhooking of said elongated support end portion hook contour from said boom with movement of a user's hand, thereby providing substantially immediate disengagement of said hook contour to release said boom from said palm harness.

2. The palm harness according to claim 1 wherein said elongated support is constructed of a flexible material with a substantially rigid insert within said flexible material at said second end to define said curved hook shape of said end portion at said second end of said elongated support.

3. The palm harness according to claim 1 wherein said curved hook contour is matched to said boom cross sectional shape to not grip the same when hooked to said boom to allow immediate unrestrained release.

4. The palm harness according to claim 3 wherein said hook shape has a tip which is flared out slightly to insure a non gripping engagement with said boom.

5. A palm harness as set forth in claim 4 wherein said finger securer loop is positioned adjacent an apex of the curved hook end portion of said elongated support.

6. A palm harness as set forth in claim 5 wherein said wrist strap includes a securing tab having a cooperating portion extending from a side of said wrist strap opposite and longitudinally aligned with said first end of said grip support for engaging with said cooperating portion of said grip support and attaching said second distal end thereof to said wrist strap.

7. A palm harness as set forth in claim 1 wherein said wrist strap includes a closure device for adjustably securing first and second ends of said wrist strap together.

8. A palm harness as set forth in claim 7 wherein said finger securer loop includes a first strap and a second strap, each strap including a mating portion of a closure device for removably interconnecting said first and second straps and adjustably securing said support to at least one finger.

9. The palm harness according to claim 1 wherein said elongated support including an inner and outer layer of flexible material secured together to form a pocket therebetween and said end portion shape is defined by a J-shaped insert positioned in said pocket and fixedly secured between said inner and outer layers.

10. The palm harness according to claim 1 wherein said elongated end portion comprises a short flexible strap attached at one end to said wrist strap and a substantially rigid hooked piece having a shank end secured to a second end of said short strap.

* * * * *